US008075715B2

(12) United States Patent
Ashcroft et al.

(10) Patent No.: US 8,075,715 B2
(45) Date of Patent: Dec. 13, 2011

(54) REACTIVE COMPOSITIONS INCLUDING METAL

(75) Inventors: Benjamin N. Ashcroft, Perry, UT (US); Daniel B. Nielson, Tremonton, UT (US); Daniel W. Doll, Marriott Slaterville, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 1195 days.

(21) Appl. No.: 11/620,205

(22) Filed: Jan. 5, 2007

(65) Prior Publication Data

US 2010/0276042 A1 Nov. 4, 2010

Related U.S. Application Data

(63) Continuation of application No. 10/801,946, filed on Mar. 15, 2004, now abandoned.

(51) Int. Cl.

| | |
|---|---|
| ***C06B 45/00*** | (2006.01) |
| ***C06B 45/04*** | (2006.01) |
| ***C06B 33/00*** | (2006.01) |
| ***C06B 33/06*** | (2006.01) |
| ***C06B 33/04*** | (2006.01) |
| ***D03D 23/00*** | (2006.01) |
| ***D03D 43/00*** | (2006.01) |

(52) U.S. Cl. ..... 149/2; 149/17; 149/37; 149/42; 149/43; 149/108.2; 149/109.2

(58) Field of Classification Search ..... 149/19.3, 149/2, 17, 37, 42, 43, 108.2, 109.2
See application file for complete search history.

(56) References Cited

U.S. PATENT DOCUMENTS

| | | | | |
|---|---|---|---|---|
| 359,491 | A | | 3/1887 | Bagger |
| 2,217,645 | A | | 10/1940 | DeWilde et al. |
| 2,398,287 | A | | 4/1946 | Christie |
| 2,425,005 | A | | 8/1947 | Rechel |
| 2,446,268 | A | | 8/1948 | Dawson |
| 2,703,531 | A | | 3/1955 | Graumann et al. |
| 2,961,712 | A | | 11/1960 | Davis |
| 3,133,841 | A | | 5/1964 | Kuehl |
| 3,158,994 | A | | 12/1964 | Hodgson |
| 3,191,535 | A | | 6/1965 | Mulloy |
| 3,325,316 | A | | 6/1967 | MacDonald |
| 3,348,484 | A | | 10/1967 | Grandy |
| 3,414,443 | A | | 12/1968 | Pheasant |
| 3,434,420 | A | | 3/1969 | Ciccone et al. |
| 3,463,047 | A | | 8/1969 | Germershausen |
| 3,669,020 | A | | 6/1972 | Waite et al. |
| 3,677,183 | A | | 7/1972 | Talley |
| 3,730,093 | A | | 5/1973 | Cummings |
| 3,745,076 | A | * | 7/1973 | Sickman et al. ..... 149/19.5 |
| 3,770,525 | A | | 11/1973 | Villey-Desmeserets et al. |
| 3,799,054 | A | | 3/1974 | LaRocca |
| 3,894,867 | A | | 7/1975 | Fishman et al. |
| 3,951,068 | A | | 4/1976 | Schroeder |
| 3,961,576 | A | | 6/1976 | Montgomery, Jr. |
| 3,978,796 | A | | 9/1976 | Hackman |
| 3,980,612 | A | | 9/1976 | Gangal |
| 4,006,687 | A | | 2/1977 | Ridgeway |
| 4,011,818 | A | | 3/1977 | Stosz, Jr. et al. |
| 4,029,868 | A | | 6/1977 | Carlson |
| 4,037,539 | A | | 7/1977 | Hackman |
| 4,096,804 | A | | 6/1978 | Bilsbury |
| 4,106,411 | A | | 8/1978 | Borcher et al. |
| 4,112,846 | A | | 9/1978 | Gilbert et al. |
| 4,131,498 | A | | 12/1978 | Lucy |
| 4,153,661 | A | | 5/1979 | Ree et al. |
| 4,154,633 | A | * | 5/1979 | Pierce ..... 149/19.92 |
| 4,179,992 | A | | 12/1979 | Ramnarace et al. |
| 4,237,787 | A | | 12/1980 | Wacula et al. |
| 4,280,408 | A | | 7/1981 | Weber et al. |
| 4,348,958 | A | | 9/1982 | Day |
| 4,351,240 | A | | 9/1982 | McCubbin et al. |
| 4,368,296 | A | | 1/1983 | Kuhls et al. |
| 4,381,692 | A | | 5/1983 | Weintraub |
| 4,419,936 | A | | 12/1983 | Coates et al. |
| 4,432,816 | A | | 2/1984 | Kennedy et al. |
| 4,435,481 | A | | 3/1984 | Baldi |
| 4,449,456 | A | | 5/1984 | Foss et al. |

(Continued)

FOREIGN PATENT DOCUMENTS

| | | | |
|---|---|---|---|
| DE | 315857 | | 6/1920 |
| DE | 10224503 | A | 12/2002 |
| EP | 0051375 | | 1/1989 |
| EP | 0487472 | A1 | 5/1992 |
| EP | 0487473 | A1 | 5/1992 |
| EP | 0684938 | B1 | 12/1995 |
| EP | 0770449 | A1 | 5/1997 |
| FR | 856233 | | 6/1940 |
| FR | 2749382 | | 12/1997 |
| GB | 384966 | A | 12/1932 |

(Continued)

OTHER PUBLICATIONS

Fischer, S.H., et al., "Theoretical Energy Release of Thermites, Intermetallics, and Combustible Metals," To be presented at the 24th International Pyrotechnics Seminar, Monterey, CA, Jul. 1998, 61 pages.

(Continued)

*Primary Examiner* — James McDonough
(74) *Attorney, Agent, or Firm* — TraskBritt

(57) ABSTRACT

A precursor composition of a reactive material that comprises a metal material and an energetic material, such as at least one oxidizer or at least one class 1.1 explosive. The metal material defines a continuous phase at a processing temperature of the precursor composition and the energetic material is dispersed therein. The metal material may be a fusible metal alloy having a melting point ranging from approximately 46° C. to approximately 250° C. The fusible metal alloy may include at least one metal selected from the group consisting of bismuth, lead, tin, cadmium, indium, mercury, antimony, copper, gold, silver, and zinc. The reactive composition may have a density of greater than approximately 2 g/cm$^3$. The reactive composition may also include a polymer/plasticizer system.

16 Claims, 7 Drawing Sheets

U.S. PATENT DOCUMENTS 4,503,776 A 3/1985 Nussbaum et al.
4,572,077 A 2/1986 Antoine et al.
4,612,860 A 9/1986 Flatau
4,655,139 A 4/1987 Wilhelm
4,662,280 A 5/1987 Becker et al.
4,665,113 A 5/1987 Eberl
4,693,181 A 9/1987 Dadley et al.
4,747,892 A 5/1988 Spencer
H0540 H 11/1988 Caponi
4,807,795 A 2/1989 LaRocca et al.
4,853,294 A 8/1989 Everett et al.
4,955,939 A 9/1990 Petrousky et al.
4,958,570 A 9/1990 Harris
4,970,960 A 11/1990 Feldmann
4,985,190 A 1/1991 Ishikawa et al.
5,045,114 A 9/1991 Bigalk et al.
5,049,212 A 9/1991 Colick
5,055,539 A 10/1991 Hengel et al.
5,067,995 A * 11/1991 Nutt ..... 149/2
H1047 H 5/1992 Henderson et al.
5,157,225 A 10/1992 Adams et al.
5,175,392 A 12/1992 Denis
5,198,616 A 3/1993 Anderson
5,259,317 A 11/1993 Lips
5,313,890 A 5/1994 Cuadros
5,323,707 A 6/1994 Norton et al.
5,339,624 A 8/1994 Calsson et al.
5,411,615 A 5/1995 Sumrail et al.
H1504 H 12/1995 Crabtree
5,472,536 A 12/1995 Doris et al.
5,474,625 A 12/1995 Duong et al.
5,518,807 A 5/1996 Chan et al.
5,531,844 A 7/1996 Brown et al.
5,535,679 A 7/1996 Craddock
5,549,948 A 8/1996 Blong et al.
5,672,843 A 9/1997 Evans et al.
5,710,217 A 1/1998 Blong et al.
5,763,519 A 6/1998 Springsteen
5,792,977 A 8/1998 Chawla
5,801,325 A 9/1998 Willer et al.
5,811,726 A 9/1998 Brown et al.
5,852,256 A 12/1998 Hornig
5,886,293 A 3/1999 Nauflett et al.
5,913,256 A 6/1999 Lowden et al.
5,945,629 A 8/1999 Schildknecht et al.
5,997,668 A 12/1999 Aubert et al.
6,042,702 A 3/2000 Kolouch et al.
6,105,505 A 8/2000 Jones
6,115,894 A 9/2000 Huffman
6,119,600 A 9/2000 Burri
6,132,536 A 10/2000 Hohmann et al.
6,186,072 B1 2/2001 Hickerson, Jr. et al.
6,293,201 B1 9/2001 Consaga
6,308,634 B1 10/2001 Fong
6,315,847 B1 11/2001 Lee et al.
6,334,394 B1 1/2002 Zimmermann et al.
6,354,222 B1 3/2002 Becker et al.
6,363,828 B1 4/2002 Sherlock et al.
6,371,219 B1 4/2002 Collins et al.
6,427,599 B1 8/2002 Posson et al.
6,439,315 B2 * 8/2002 Onuki ..... 169/37
6,484,642 B1 11/2002 Kuhns et al.
6,485,586 B1 11/2002 Gill et al.
6,536,351 B2 3/2003 Böcker et al.
6,547,993 B1 4/2003 Joshi
6,588,344 B2 7/2003 Clark et al.
6,593,410 B2 7/2003 Nielson et al.
6,635,130 B2 10/2003 Koch
6,659,013 B1 12/2003 Kellner
6,679,176 B1 1/2004 Zavitsanos et al.
6,799,518 B1 10/2004 Williams
6,832,740 B1 12/2004 Ransom
6,846,372 B1 1/2005 Guirguis
6,896,751 B2 5/2005 Posson et al.
6,945,175 B1 9/2005 Gotzmer et al.
7,000,547 B2 2/2006 Amick
7,017,496 B2 3/2006 Lloyd
7,040,235 B1 5/2006 Lloyd
7,143,698 B2 12/2006 Lloyd
7,191,709 B2 3/2007 Nechitailo
7,194,961 B1 3/2007 Nechitailo
7,231,876 B2 6/2007 Kellner
7,278,353 B2 10/2007 Langan et al.
7,278,354 B1 10/2007 Langan et al.
7,307,117 B2 12/2007 Nielson et al.
7,380,503 B2 6/2008 Williams
7,603,951 B2 10/2009 Rose et al.
7,614,348 B2 11/2009 Truitt et al.
7,621,222 B2 11/2009 Lloyd
2001/0003295 A1 * 6/2001 Langlotz et al. ..... 149/19.91
2003/0037692 A1 2/2003 Liu
2003/0140811 A1 7/2003 Bone
2004/0020397 A1 2/2004 Nielson et al.
2004/0116576 A1 6/2004 Nielson
2005/0067072 A1 3/2005 Vavrick
2005/0087088 A1 4/2005 Lacy et al.
2005/0199323 A1 9/2005 Nielson et al.
2006/0011086 A1 1/2006 Rose et al.
2006/0086279 A1 4/2006 Lloyd
2007/0272112 A1 11/2007 Nielson et al.
2008/0202373 A1 8/2008 Hugus et al.
2009/0211484 A1 8/2009 Truitt et al.
2009/0320711 A1 12/2009 Lloyd

FOREIGN PATENT DOCUMENTS

GB 488909 A 7/1938
GB 588671 A 11/1944
GB 968507 A 11/1960
GB 1007227 10/1965
GB 1 591 092 A 6/1981
RU 2100763 C1 12/1997
WO 9321135 A1 10/1993
WO WO 96/07700 A 3/1996
WO WO 0062009 A1 10/2000
WO WO 0177607 10/2001
WO WO 02/00741 A 1/2002
WO 0240213 A1 5/2002
WO WO 02/40213 5/2002

OTHER PUBLICATIONS

UK Search Report of Jun. 29, 2005.
Search Report for French Application No. 0502374, dated Oct. 24, 2007.
DuPont Fluoropolymers Food Processing and Industrial Bakeware Coatings http://www.dupont.com/teflon/bakeware/power.html © 2003 E.I. DuPont de Nemours and Company.
DuPont Teflon® Industrial Coatings http://www.dupont.com/teflon/coatings/basic_types.html © 2003 E.I. DuPont de Nemours and Company.
HACKH's Chemical Dictionary 4th Ed. Dec. 4, 1974 p. 663.
Lycos Wired News Adding More Bang to Navy Missiles 5 pages Dec. 26, 2002 http://wired.com.
Partial European Search Report dated Jul. 20, 2004.
Partial European Search Report for European Application No. 06020829 dated Oct. 30, 2007.
Patriot Advanced Capability-3 (PAC-3) 17 pages Various Dates as viewed at http://www.missilethreat.com on Nov. 27, 2006.
Patriot Air & Missile Defense System: How Patriot Works http://static.howstuffworks.com © 2002 Raytheon Company.
Reactive Tungsten Alloy for Inert Warheads Navy SBIR FY2004.2 1 page.
Search Report dated Nov. 8, 2005 prepared by the EPO for the French Patent Office.
SpaceRef.com Better Warheads Through Plastics from Defense Advanced Research Projects Agency (DARPA) 2 pages Dec. 2, 2002 http://www.spaceref.com.
The Ordnance Shop Sidewinder Guided Missile 3 pages as viewed at http://www.ordnance.org on Jul. 26, 2006.
UK Search Report of Jul. 1, 2005.
UK Search Report of Jun. 8, 2005.
U.S. Appl. No. 10/801,946, filed Mar. 15, 2004 entitled Reactive Compositions Including Metal and Methods of Forming Same.
Zumdahl Steven S. Chemistry Polymers pp. 931-934 (no date).

3M Material Safety Data Sheet pp. 1-7 © 2005 3M Company.
Indium Corporation of America Europe and Asia Indalloy Speciality Alloys Mechanical Properties as viewed at www.indium.com on Aug. 7, 2006.
U.S. Appl. No. 11/512,058, filed Aug. 29, 2006 entitled Weapons and Weapon Components Incorporating Reactive Materials and Related Methods.
U.S. Appl. No. 11/538,763, filed Oct. 4, 2006 entitled Reactive Material Enhanced Projectiles and Related Methods.
U.S. Appl. No. 11/690,016, filed Mar. 22, 2007 entitled Reactive Material Compositions Shot Shells Including Reactive Materials and a Method of Producing Same.
PCT International Search Report for International Application No. PCT/US2007/076672 mailed Jul. 28, 2008.
Reactive Materials Advanced Energetic Materials (2004) http://www.nap.com © 2004, The National Academy of Sciences pp. 20-23.
French Search Report dated Oct. 18, 2007 for French Patent Application No. FR 0502373.
Wood's Metalor, http://en.wikipedia.org/wiki/Wood%27s_metalor, accessed Jul. 5, 2011, 1 page.
Safety Data for Wood's Metal, http://en.wikipedia.org/wiki/Wood%27s_metalor, accessed Jul. 5, 2011, 2 pages.
French Search Report dated Oct. 18, 2007, for French Patent Application No. FR 0502373.

* cited by examiner

REACTIVE COMPOSITIONS INCLUDING METAL

CROSS-REFERENCE TO RELATED APPLICATION

This application is a continuation of U.S. patent application Ser. No. 10/801,946, filed Mar. 15, 2004, now abandoned. The disclosure of the previously referenced U.S. patent application is hereby incorporated herein by reference in its entirety.

The present application is also related to U.S. Provisional Patent Application No. 60/368,284, filed Mar. 28, 2002, entitled "Low Temperature, Extrudable, High Density Reactive Materials", now abandoned; U.S. Pat. No. 6,962,634, issued Nov. 8, 2005, entitled "Low Temperature, Extrudable, High Density Reactive Materials"; U.S. patent application Ser. No. 12/507,605, filed Jul. 22, 2009, entitled "Low Temperature, Extrudable, High Density Reactive Materials", pending; U.S. Provisional Patent Application No. 60/184,316, filed Feb. 23, 2000, entitled "High Strength Reactive Materials", now abandoned; U.S. Pat. No. 6,593,410, issued Jul. 15, 2003, entitled "High Strength Reactive Materials"; U.S. Pat. No. 7,307,117, issued Dec. 11, 2007, entitled "High Strength Reactive Materials And Methods Of Making"; U.S. Provisional Application No. 60/553,430, filed Mar. 15, 2004, entitled "Reactive Material Enhanced Projectiles and Related Methods", now abandoned; U.S. Pat. No. 7,603,951, issued Oct. 20, 2009, entitled "Reactive Material Enhanced Projectiles and Related Methods"; U.S. patent application Ser. No. 10/801,948, filed Mar. 15, 2004, entitled "Reactive Material Enhanced Munition Compositions and Projectiles Containing Same", now abandoned; U.S. patent application Ser. No. 12/127,627, filed May 27, 2008, entitled "Reactive Material Enhanced Munition Compositions and Projectiles Containing Same", pending; U.S. Provisional Application No. 60/723,465, filed Oct. 4, 2005, entitled "Reactive Material Enhanced Projectiles And Related Methods", now abandoned; U.S. patent application Ser. No. 11/538,763, filed Oct. 4, 2006, entitled "Reactive Material Enhanced Projectiles And Related Methods", pending; U.S. Pat. No. 7,614,348, issued Nov. 10, 2009, entitled "Weapons And Weapon Components Incorporating Reactive Materials And Related Methods"; U.S. patent application Ser. No. 11/697,005, filed Apr. 5, 2007, entitled "Consumable Reactive Material Fragments, Ordnance Incorporating Structures For Producing The Same, And Methods Of Creating The Same", pending; and U.S. patent application Ser. No. 11/690,016, filed Mar. 22, 2007, entitled "Reactive Material Compositions, Shot Shells Including Reactive Materials, and a Method of Producing Same", pending.

FIELD OF THE INVENTION

This invention relates generally to an insensitive, highly energetic composition. More specifically, the invention relates to a composition that includes a metal material and an energetic material.

BACKGROUND OF THE INVENTION

Many explosive, pyrotechnic, and incendiary compositions are known in the art. To form these compositions, a fuel is typically dispersed in an organic, energetic material, such as in trinitrotoluene ("TNT"). TNT is commonly used as the energetic material in explosive compositions because it is stable and insensitive. Some common examples of military explosives that include TNT are tritonal, cyclotol, Composition B, DBX, and octol. Tritonal includes 20% aluminum and 80% TNT. Cyclotol includes 65%-75% cyclo-1,3,5-trimethylene-2,4,6-trinitramine ("RDX"; also known as hexogen or cyclonite) and 25-35% TNT. Composition B includes 60-64% RDX and 36-40% TNT. DBX includes 21% RDX, 21% ammonium nitrate, 18% aluminum, and 40% TNT. Octol includes 70-75% cyclotetramethylene tetranitramine ("HMX"; also known as octogen) and 25-30% TNT. These TNT-containing explosive compositions are produced into a usable form by casting or pressing processes. Casting is more versatile and convenient for loading the explosive, pyrotechnic, or incendiary composition than pressing and, therefore, is a more desirable process.

In casting, the energetic material is heated to a temperature above its melting point to produce a liquid phase, which is also referred to as a melt phase or a casting material. The energetic material is melted by placing it in a vessel, such as a kettle, and heating to a temperature above its melting point. The fuel, which is typically a solid material, is then dispersed in the organic melt phase. In such a mixture, the energetic material forms a continuous phase and the fuel is a dispersed phase. The mixture is poured into a container, such as a mold or a charge case, and allowed to solidify by cooling to produce the explosive, pyrotechnic, or incendiary composition. This technique is known as a "melt-pour" process because the energetic material is melted, the fuel is added, and the resulting mixture is poured into the desired mold. Many explosive, pyrotechnic, or incendiary compositions that contain TNT as an energetic material are produced by melt-pour processes because TNT has a relatively low melting point compared to the other components in conventional compositions. TNT has a melting point of approximately 81° C. and remains a liquid at temperatures ranging from approximately 81° C. to 105° C. In contrast, many other chemical components of the explosive, pyrotechnic, or incendiary compositions, such as RDX and HMX, have melting points greater than 200° C. One example of an explosive composition produced by a melt-pour process is tritonal, which contains aluminum and TNT. The aluminum is present as a powder and is dispersed in the TNT.

Explosive, pyrotechnic, and incendiary compositions also typically have a density of 1.5 g/cm$^3$-1.7 gm/cm$^3$. However, explosive, pyrotechnic, or incendiary compositions with higher densities have improved performance attributes and, therefore, are desired. While the performance attributes cannot be expressed by a single parameter, military explosives typically require a higher performance concentration per unit volume, a faster reaction rate, an increased detonation velocity, and a larger impact effect of detonation than industrial explosives. However, the performance attributes of military explosives also depend on a desired application for the explosive composition. For instance, if the explosive, pyrotechnic, or incendiary composition is used in mines, bombs, mine projectiles, or rocket warhead charges, the composition should have a high gas impact, a large gas volume, and a high heat of explosion. If the explosive, pyrotechnic, or incendiary composition is used in grenades, the composition should have a high speed splinter formation, a high loading density, and a high detonation velocity. In shaped charges, the explosive, pyrotechnic, or incendiary composition should have a high density, a high detonation velocity, a high strength, and high brisance. Brisance is the destructive fragmentation effect of a charge on its immediate vicinity and is used to measure the effectiveness of the composition. Brisance depends on the detonation velocity, heat of explosion, gas yield, and compactness or density of the composition.

Numerous explosive compositions are known in the art. As described in U.S. Pat. No. 5,339,624, WO 93/21135, and EP 0487472, all to Caisson et al., an explosive composition having a mechanical alloy is disclosed. The mechanical alloy is formed from solid dispersions of metallic materials, with at least one of the metallic materials being a ductile metal. The metallic materials react exothermically with one another to form a fusible alloy that provides additional energy to the explosion. The metallic materials include titanium, boron, zirconium, nickel, manganese and aluminum.

It would be desirable to produce a composition that is highly insensitive and highly energetic for use in military and industrial explosives. Optionally, the desired composition would be suitable for production in existing melt-pour facilities so that new equipment and facilities do not have to be developed.

BRIEF SUMMARY OF THE INVENTION

The present invention comprises a reactive composition that includes a metal material and an energetic material, such as at least one oxidizer, at least one class 1.1 explosive, or mixtures thereof. The metal material defines a continuous phase and has the energetic material dispersed therein. The metal material may have a density greater than approximately 7 g/cm$^3$ and may be a fusible metal alloy having a melting point ranging from approximately 46° C. to approximately 250° C. The fusible metal alloy may include at least one metal selected from the group consisting of bismuth, lead, tin, cadmium, indium, mercury, antimony, copper, gold, silver, and zinc. The energetic material may be selected from the group consisting of ammonium perchlorate, potassium perchlorate, sodium nitrate, potassium nitrate, ammonium nitrate, lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, copper oxide, trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.0$^{5,9}$.0$^{3,11}$]-dodecane, 1,3,3-trinitroazetidine, ammonium dinitramide, 2,4,6-trinitro-1,3,5-benzenetriamine, dinitrotoluene, sulfur, and mixtures thereof. The reactive composition may have a density greater than approximately 2 g/cm$^3$.

The reactive composition may further include a polymer/plasticizer system. The polymer/plasticizer system may include at least one polymer selected from the group consisting of polyglycidyl nitrate, nitratomethylmethyloxetane, polyglycidyl azide, diethyleneglycol triethyleneglycol nitraminodiacetic acid terpolymer, poly(bis(azidomethyl)oxetane), poly(azidomethylmethyl-oxetane), poly(nitraminomethyl methyloxetane), poly(bis(difluoroaminomethyl) oxetane), poly(difluoroaminomethylmethyloxetane), copolymers thereof, cellulose acetate butyrate, nitrocellulose, nylon, polyester, fluoropolymers, energetic oxetanes, waxes, and mixtures thereof. The polymer/plasticizer system may also include at least one plasticizer selected from the group consisting of bis(2,2-dinitropropyl)acetal/bis(2,2-dinitropropyl)formal, dioctyl sebacate, dimethylphthalate, dioctyladipate, glycidyl azide polymer, diethyleneglycol dinitrate, butanetrioltrinitrate, butyl-2-nitratoethyl-nitramine, trimethylolethanetrinitrate, triethylene glycoldinitrate, nitroglycerine, isodecylperlargonate, dioctylphthalate, dioctylmaleate, dibutylphthalate, di-n-propyl adipate, diethylphthalate, dipropylphthalate, citroflex, diethyl suberate, diethyl sebacate, diethyl pimelate, and mixtures thereof.

The present invention also comprises a method of producing a reactive composition. The method includes providing a metal material in a liquid state and adding an energetic material to the metal material. The metal material may be a fusible metal alloy having a melting point below a processing temperature of the reactive composition. For instance, the metal material may be a fusible metal alloy having a melting point ranging from approximately 46° C. to approximately 250° C. The fusible metal alloy may include at least one metal selected from the group consisting of bismuth, lead, tin, cadmium, indium, mercury, antimony, copper, gold, silver, and zinc. The energetic material may be selected from the group consisting of ammonium perchlorate, potassium perchlorate, sodium nitrate, potassium nitrate, ammonium nitrate, lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, copper oxide, trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.0$^{5,9}$.0$^{3,11}$]-dodecane, 1,3,3-trinitroazetidine, ammonium dinitramide, 2,4,6-trinitro-1,3,5-benzenetriamine, dinitrotoluene, sulfur, and mixtures thereof. The reactive composition may have a density greater than approximately 2 g/cm$^3$.

The method may further include adding a polymer/plasticizer system to the reactive composition. The polymer/plasticizer system may include at least one polymer selected from the group consisting of polyglycidyl nitrate, nitratomethylmethyloxetane, polyglycidyl azide, diethyleneglycol triethyleneglycol nitraminodiacetic acid terpolymer, poly(bis(azidomethyl)-oxetane), poly(azidomethylmethyl-oxetane), poly(nitraminomethyl methyloxetane), poly(bis(difluoroaminomethyl)oxetane), poly(difluoroaminomethylmethyloxetane), copolymers thereof, cellulose acetate butyrate, nitrocellulose, nylon, polyester, fluoropolymers, energetic oxetanes, waxes, and mixtures thereof. The polymer/plasticizer system may also include at least one plasticizer selected from the group consisting of bis(2,2-dinitropropyl)acetal/bis(2,2-dinitropropyl)formal, dioctyl sebacate, dimethylphthalate, dioctyladipate, glycidyl azide polymer, diethyleneglycol dinitrate, butanetrioltrinitrate, butyl-2-nitratoethyl-nitramine, trimethylolethanetrinitrate, triethylene glycoldinitrate, nitroglycerine, isodecylperlargonate, dioctylphthalate, dioctylmaleate, dibutylphthalate, di-n-propyl adipate, diethylphthalate, dipropylphthalate, citroflex, diethyl suberate, diethyl sebacate, diethyl pimelate, and mixtures thereof.

The present invention also comprises a method of improving homogeneity of a reactive composition. The method includes providing a metal material in a liquid state. The metal material may be a fusible metal alloy having a melting point ranging from approximately 46° C. to approximately 250° C. The fusible metal alloy may include at least one metal selected from the group consisting of bismuth, lead, tin, cadmium, indium, mercury, antimony, copper, gold, silver, and zinc. The metal material may be present in the reactive composition from approximately 13.5% by weight to approximately 85% by weight. An energetic material is added to the metal material in the liquid state. The energetic material may be selected from the group consisting of ammonium perchlorate, potassium perchlorate, sodium nitrate, potassium nitrate, ammonium nitrate, lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, copper oxide, trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.0$^{5,9}$.0$^{3,11}$]-dodecane, 1,3,3-trinitroazetidine, ammonium dinitramide, 2,4,6-trinitro-1,3,5-benzenetriamine, dinitrotoluene, sulfur, and mixtures thereof.

A polymer/plasticizer system is added to a mixture of the energetic material and the metal material. The polymer/plasticizer system may include at least one polymer selected from the group consisting of polyglycidyl nitrate, nitratomethylmethyloxetane, polyglycidyl azide, diethyleneglycol triethyleneglycol nitraminodiacetic acid terpolymer, poly(bis(azidomethyl)-oxetane), poly(azidomethylmethyl-oxetane), poly(nitraminomethyl methyloxetane), poly(bis(difluoroaminomethyl)oxetane), poly(difluoroaminomethylmethyloxetane), copolymers thereof, cellulose acetate butyrate, nitrocellulose, nylon, polyester, fluoropolymers, energetic oxetanes, waxes, and mixtures thereof. The polymer/plasticizer system may also include at least one plasticizer selected from the group consisting of bis(2,2-dinitropropyl)acetal/bis(2,2-dinitropropyl)formal, dioctyl sebacate, dimethylphthalate, dioctyladipate, glycidyl azide polymer, diethyleneglycol dinitrate, butanetrioltrinitrate, butyl-2-nitratoethyl-nitramine, trimethylolethanetrinitrate, triethylene glycoldinitrate, nitroglycerine, isodecylperlargonate, dioctylphthalate, dioctylmaleate, dibutylphthalate, di-n-propyl adipate, diethylphthalate, dipropylphthalate, citroflex, diethyl suberate, diethyl sebacate, diethyl pimelate, and mixtures thereof.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
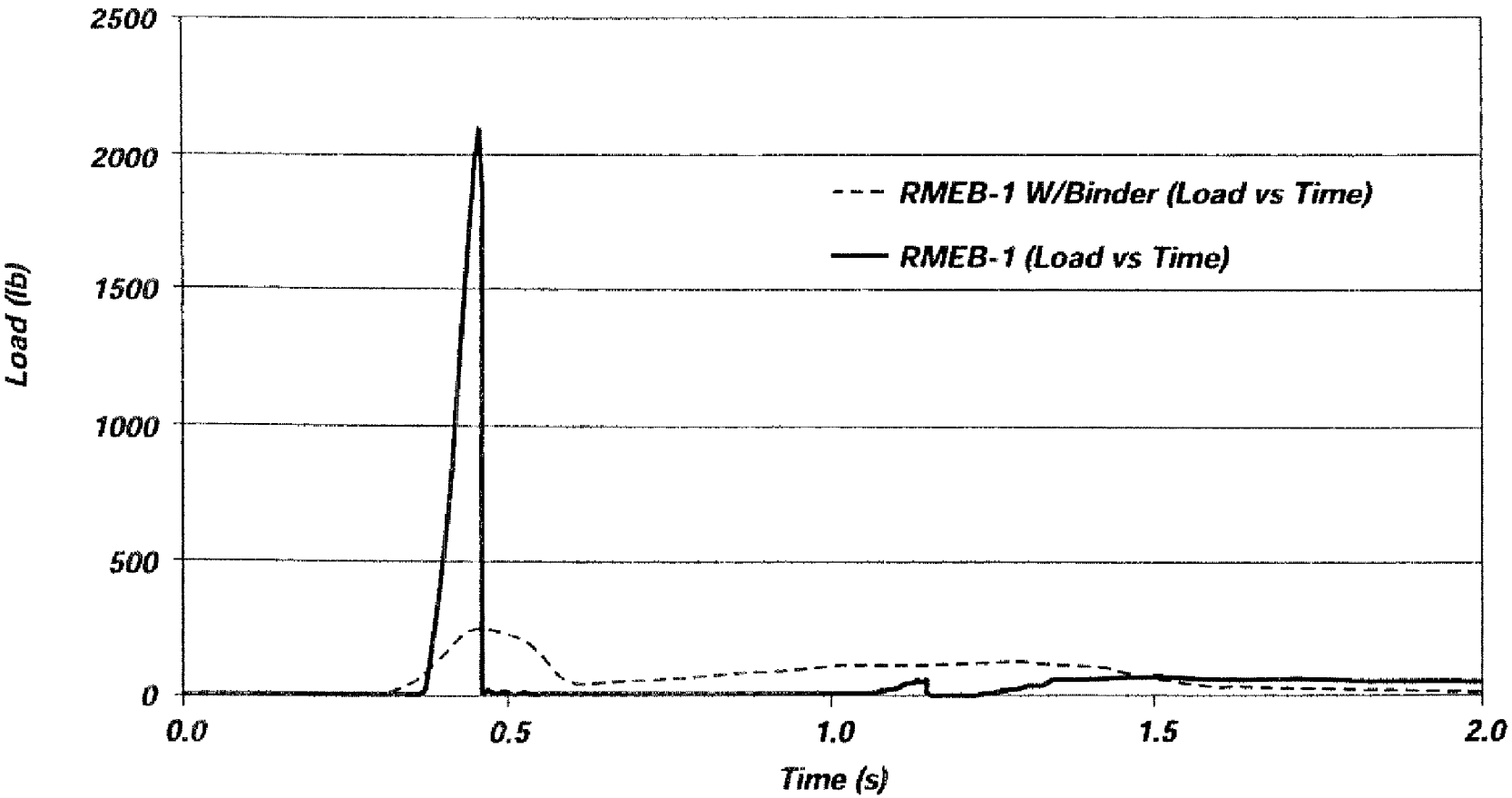
FIGS. 1-3 illustrate compressive strength test results of reactive compositions according to the present invention that include the polymer/plasticizer system.

A reactive composition that includes a metal material and an energetic material is disclosed. The metal material defines a continuous phase into which the energetic material is dispersed. The reactive composition may produce at least one of light, heat, motion, noise, pressure, or smoke when initiated. The metal material provides a metallic melt phase into which the energetic material may be added and dispersed. By utilizing a metal material that is capable of providing a metallic melt phase, the reactive composition may have an improved performance compared to conventional reactive compositions. The reactive composition may be highly energetic when intentionally discharged but also insensitive to accidental discharge. As such, the reactive composition may have utility in a wide range of ordnance, such as in bullets, reactive bullets, grenades, warheads (including shape charges), mines, mortar shells, artillery shells, bombs, and demolition charges.

The metal material may be a metal or a metal alloy having a melting point lower than a temperature used to process the reactive composition. The melting point of the metal material may range from approximately 46° C. to approximately 250° C., such as from approximately 75° C. to approximately 105° C. The metal material may have a density of greater than approximately 7 g/cm$^3$ and may be unreactive with other components of the reactive composition, such as the energetic material. If the metal material is an elemental metal, the elemental metal may include gallium ("Ga"), indium ("In"), lithium ("Li"), potassium ("K"), sodium ("Na"), or tin ("Sn"). The metal material may also be a fusible metal alloy. As used herein, the term "fusible metal alloy" refers to an eutectic or noneutectic alloy that includes transition metals, post-transition metals, or mixtures thereof, such as metals from Group III, Group IV, and/or Group V of the Periodic Table of the Elements. The metals used in the fusible metal alloy may include, but are not limited to, bismuth ("Bi"), lead ("Pb"), tin ("Sn"), cadmium ("Cd"), indium ("In"), mercury ("Hg"), antimony ("Sb"), copper ("Cu"), gold ("Au"), silver ("Ag"), and/or zinc ("Zn"). Fusible metal alloys are known in the art and are commercially available from sources including, but not limited to, Indium Corp. of America (Utica, N.Y.), Alchemy Castings (Ontario, Canada), and Johnson Mathey PLC (Wayne, Pa.). While the fusible metal alloy may include any of the previously mentioned metals, the fusible metal alloy may be free of toxic metals, such as lead and mercury, to minimize environmental concerns associated with clean-up of the reactive composition.

For the sake of example only, the fusible metal alloy may be Wood's Metal, which has 50% Bi, 25% Pb, 12.5% Sn, and 12.5% Cd and is available from Sigma-Aldrich Co. (St. Louis, Mo.). Wood's Metal has a melting point of approximately 70° C. and a density of 9.58 g/cm$^3$. The fusible metal alloy may also be INDALLOY® 174, which has 57% Bi, 26%© In, and 17% Sn.

INDALLOY® 174 has a melting point of 174° F. (approximately 79° C.), a density of 8.54 g/cm$^3$, and is commercially available from Indium Corp. of America (Utica, N.Y.). INDALLOY® 162, which has 33.7% Bi and 66.3% In, may also be used as the fusible metal alloy. INDALLOY® 162 has a melting point of 162° F. (approximately 72° C.), a density of 7.99 g/cm$^3$, and is commercially available from Indium Corp. of America (Utica, N.Y.). Other INDALLOY® materials are available from Indium Corp. of America and may be used in the reactive composition. These INDALLOY® materials are available in a range of melting points (from approximately 60° C. to approximately 300° C.) and include a variety of different metals. As such, the fusible metal alloy may be selected depending on a desired melting point and the metals used in the fusible metal alloy.

The energetic material used in the reactive composition may be an organic or inorganic energetic material, such as at least one class 1.1 explosive, at least one oxidizer, or mixtures thereof. Any conventional energetic material may be used in the reactive composition provided that the energetic material does not decompose at the temperature used to process the reactive composition. The energetic material may be a solid material at ambient temperature and either a solid or a liquid material at the processing temperature. The energetic material may also have a density that is less than the density of the metal material. Preferably, the energetic material has a density of less than approximately 2.5 g/cm$^3$. For instance, if the energetic material is an organic material, it may have a density less than approximately 2.0 g/cm$^3$. If the energetic material is an inorganic material, the density may be less than approximately 2.5 g/cm$^3$. The class 1.1 explosive may include, but is not limited to, TNT, RDX, HMX, hexanitrohexaazaisowurtzitane ("CL-20"; also known as HNIW), 4,10-dinitro-2,6,8,12-tetraoxa-4,10-diazatetracyclo-[5.5.0.0$^{5,9}$.0$^{3,11}$]- dodecane ("TEX"), ammonium dinitramide ("ADN"), 1,3,3-trinitroazetidine ("TNAZ"), 2,4,6-trinitro-1,3,5-benzenetriamine ("TATB"), dinitrotoluene ("DNT"), and mixtures thereof. The oxidizer may be sulfur or a nitrate, perchlorate, or oxide, such as an alkali or alkaline metal nitrate, an alkali or alkaline metal perchlorate, or an alkaline metal peroxide including, but not limited to, ammonium nitrate ("AN"), ammonium perchlorate ("AP"), sodium nitrate ("SN"), potassium nitrate ("KN"), lithium nitrate, rubidium nitrate, cesium nitrate, lithium perchlorate, sodium perchlorate, potassium perchlorate ("KP"), rubidium perchlorate, cesium perchlorate, magnesium perchlorate, calcium perchlorate, strontium perchlorate, barium perchlorate, barium peroxide, strontium peroxide, copper oxide, and mixtures thereof. While the examples described herein disclose that the reactive composition includes a single energetic material and a single fusible metal alloy, the reactive composition may also include more than one energetic material as well as more than one fusible metal alloy. Therefore, the reactive composition may be described as including at least one energetic material and at least one fusible metal alloy.

The relative amounts of the metal material and the energetic material present in the reactive composition may vary depending on the desired application for the reactive composition. For instance, the metal material may be present in the reactive composition from approximately 10% to approximately 90%. The energetic material may be present from approximately 10% to approximately 90%.

The reactive composition may optionally include additional components depending on a desired application for the reactive composition. The additional components may optionally be present in the reactive composition at a minimum amount sufficient to provide the desired properties. For instance, the reactive composition may optionally include a second metal material that remains solid at the processing temperature. The second metal material may enhance blast effects, such as to increase blast overpressures and thermal output. The second metal material may include, but is not limited to, aluminum, nickel, magnesium, silicon, boron, beryllium, zirconium, hafnium, zinc, tungsten, molybdenum, copper, or titanium, or mixtures thereof, such as aluminum hydride ("$AlH_3$" or alane), magnesium hydride ("$MgH_2$"), or borane compounds ("$BH_3$"). In addition to $BH_3$, the borane compounds may include stabilized compounds, such as $NH_3$—$BH_3$. Sulfur may also be used in the reactive composition. The second metal material may be in a powdered or granular form. The second metal material may be present in the reactive composition from approximately 0.5% to approximately 60%. Percentages of each of the components in the reactive composition are expressed herein as percentages by weight of the total reactive composition.

The reactive composition may also optionally include conventional binders or filler materials. Energetic polymers, inert polymers, or fluoropolymers may also optionally be used to optimize the rheological properties of the reactive composition or as a processing aid. The polymer may soften or melt at the processing temperature. The polymer may be present in the reactive composition from approximately 0.5% to approximately 50%, such as from approximately 0.5% to approximately 5%. The polymer may include, but is not limited to, polyglycidyl nitrate ("PGN"), nitratomethylmethyloxetane ("polyNMMO"), polyglycidyl azide ("GAP"), diethyleneglycol triethyleneglycol nitraminodiacetic acid terpolymer ("9DT-NIDA"), poly(bis(azidomethyl)oxetane) ("polyBAMO"), poly(azidomethylmethyloxetane) ("polyAMMO"), poly(nitraminomethyl methyloxetane) ("polyNAMMO"), poly(bis(difluoroaminomethyl)oxetane) ("polyBFMO"), poly(difluoroaminomethylmethyloxetane) ("polyDFMO"), copolymers thereof, and mixtures thereof. The polymer may also include cellulosic polymers, such as cellulose acetate butyrate ("CAB") or nitrocellulose; nylons; polyesters; fluoropolymers; energetic oxetanes; waxes; and mixtures thereof.

Graphite, silica, or polytetrafluoroethylene (TEFLON®) compounds may also optionally be used in the reactive composition as a processing aid or for reaction enhancement. The reactive composition may also optionally include energetic plasticizers or inert plasticizers including, but not limited to, bis(2,2-dinitropropyl)acetal/bis(2,2-dinitropropyl)formal ("BDNPA/F"), dioctyl sebacate ("DOS"), dimethylphthalate ("DMP"), dioctyladipate ("DOA"), glycidyl azide polymer ("GAP"), diethyleneglycol dinitrate ("DEGDN"), butanetrioltrinitrate ("BTTN"), butyl-2-nitratoethyl-nitramine ("BuNENA"), trimethylolethanetrinitrate ("TMETN"), triethylene-glycoldinitrate ("TEGDN"), nitroglycerine ("NG"), isodecylperlargonate ("IDP"), dioctylphthalate ("DOP"), dioctylmaleate ("DOM"), dibutylphthalate ("DBP"), di-n-propyl adipate, diethylphthalate, dipropylphthalate, citroflex, diethyl suberate, diethyl sebacate, diethyl pimelate, and mixtures thereof. The plasticizer may be present in the reactive composition from approximately 0.5% to approximately 10%, such as from approximately 0.5% to approximately 5%. As discussed below, the reactive composition may optionally include a polymer/plasticizer system. Catalysts, such as graphite, silicon, iron(III) oxide, sulfur, or nano-aluminum, may also optionally be used in the reactive composition.

In the reactive composition, the metal material provides the continuous phase and the energetic material provides the dispersed phase, which is in contrast to conventional reactive compositions where the energetic material is the continuous phase. The resulting composition may have efficient combustion and reduced sensitivity because the energetic material is coated with the metal material, which provides an intimate contact between these components.

The reactive composition may be produced by adding the energetic material to the metal material to form a substantially homogenous mixture or a heterogeneous mixture. Any optional components, such as the second metal material or any fillers, may also be added to the substantially homogenous mixture. The metal material may be in a liquid state, which is also referred to herein as a "molten metal." The molten metal may be produced by heating the metal material to a temperature above its melting point. The energetic material may then be mixed into the metal material. If the energetic material is a liquid at the processing temperature, the energetic material may be melted with the liquid state metal material to form an emulsion. Energetic materials that are liquid at the processing temperature include, but are not limited to, DNT, TNT, and TNAZ, which have melting points of 71° C., 81° C. and 101° C., respectively. If the energetic material is a solid at the processing temperature, the energetic material may be dispersed in the metal material by mixing the two components. When a solid energetic material is used, the energetic material may be present in a coarse particle size to provide a well-mixed, reactive composition. For instance, the energetic material may have a particle size ranging from approximately 5 μm to approximately 400 μM. Solid energetic materials include, but are not limited to, AP, HMX, KN, KP, and TATB, which have melting points of 220° C., 285° C., 334° C., 610° C., and 450° C., respectively. The temperature at which the reactive composition is processed may depend on the melting point of the metal material and the energetic material. In one embodiment, the processing temperature ranges from approximately 46° C. to approximately 250° C., such as from approximately 75° C. to approximately 105° C.

After mixing, the substantially homogenous mixture may be formed into the reactive composition by conventional techniques. For instance, the reactive composition may be formed by placing the substantially homogenous mixture into a mold or container having a desired shape. If the substantially homogenous mixture has a low viscosity, it may be poured into the mold. However, if the substantially homogenous mixture has a higher viscosity, it may be physically transferred to the mold. The substantially homogenous mixture may then be solidified to form the reactive composition having the desired shape.

However, when large amounts of solid additives, such as the energetic material or the optional components, are added to the metal material, a high-density gradient may be produced, resulting in low homogeneity of the reactive composition. In other words, the metal material may separate from the other components in the reactive composition. As such, the metal material may be unable to bind the energetic material or the optional components when large amounts of the solid additives are present. To improve the homogeneity and the processing of the reactive composition when large amounts of these solid additives are used, the polymer/plasticizer system may optionally be present as a processing aid.

The polymer used in the polymer/plasticizer system may have a melt temperature or softening temperature that is similar to the melt temperature of the metal material. The polymer may provide sufficient intermolecular forces to allow the polymer to be evenly distributed in the liquid phase. As previously described, the polymer may be an inert polymer, an energetic polymer, or a fluoropolymer. The plasticizer may be an inert plasticizer or an energetic plasticizer as previously described. The polymer/plasticizer system may be present in the reactive composition from approximately 0.5% to approximately 50%, such as from approximately 0.5% to approximately 5%. In one embodiment, the polymer/plasticizer system includes CAB and BDNPA/F.

The polymer/plasticizer system may form a polymeric matrix that is distributed throughout the metal material in the liquid phase. As such, the metal material may be uniformly dispersed in the reactive composition, increasing the surface area of the metal material. The polymer/plasticizer system may also enable the metal material to suspend the solid additives in the reactive composition and improve the ability of the metal material to bind to the solid additives. When the solid additives are added to the metal material, the solid additives may be evenly coated with a thin layer of the polymer and the metal material. Therefore, the ratio of surface area of the metal material to the solid additives is increased.

By utilizing the polymer/plasticizer system, performance and processability of the reactive composition may be improved. The polymer/plasticizer system may trap other components of the reactive composition in its matrix, promoting uniform mixing. As such, the polymer/plasticizer system may provide increased flexibility in formulating the reactive composition and may enable each component of the reactive composition to be mixed into a uniform blend. The polymer/plasticizer system may significantly improve performance of the reactive composition because increased amounts of the solid additives, such as increased amounts of the oxidizer, may be used. The polymer/plasticizer system may also increase processability because the polymer/plasticizer system maintains a homogenous distribution of the components during pouring, mixing, casting, and pressing of the reactive composition.

The concern may be raised that the polymer/plasticizer system, while improving processability, may reduce or degrade overall energy and performance of the reactive composition since many of the polymers and plasticizers are less energetic than other components of the reactive composition. Surprisingly, however, the polymer/plasticizer system has been shown to improve the energy and performance of the reactive composition. It is believed, without being limiting of the scope of the invention, that the metal material may be uniformly dispersed in the polymer/plasticizer system, increasing the surface area of the metal material. As the solid additives are added to this mixture, the solid additives may be evenly coated with a thin layer of the polymer and the metal material, significantly increasing the ratio of the surface area of the metal material to the solid additives. Testing performed on reactive compositions lacking the polymer/plasticizer system indicated that the metal material may have difficulty acting as a fuel because large pieces of the metal material do not react rapidly. However, a uniform, high surface area dispersion of the metal material, such as is present when the polymer/plasticizer system is used, may be able to react more completely.

If the polymer/plasticizer system is not used in the reactive composition, the reactive composition may be granulated to form a heterogenous mixture that includes crystallized particles of the metal material and small particles of the energetic material and the optional components. The granules of the reactive composition may then be pressed into a solid mass having the desired shape. When no polymer/plasticizer system is used, the metal material may be present in the reactive composition from approximately 40% to 80%, which is in contrast to the higher amounts of the metal material that may be present when the polymer/plasticizer system is used. If the metal material is present beyond this range without using the polymer/plasticizer system, it may be difficult to produce a uniform composition that is reliable from one sample to the next sample. In addition, the reactive composition formulated without the polymer/plasticizer system may lack a continuous phase and may be prone to fracture. As such, the reactive composition without the polymer/plasticizer system is limited in the amounts of the solid additives that may be used relative to the amount of the metal material.

In contrast, when the reactive composition includes the polymer/plasticizer system, the reactive composition may include a wider range of the amount of the solid additives. For instance, the reactive composition may include from approximately 13.5% of the metal material and approximately 82% of the solid additives to approximately 85% of the metal material and approximately 9% of the solid additives. In addition, the reactive composition including the polymer/plasticizer system may be substantially homogenous and uniform, which enables the reactive composition to be poured, casted, and granulated without the metal material separating from the solid additives. The reactive composition may also be pressed at lower pressures than compositions lacking the polymer/plasticizer system. The polymer/plasticizer system may also enable the reactive composition to be mixed with less shear work, increasing the safety of processing of these reactive compositions. Using the polymer/plasticizer system may also reduce the friability of the reactive composition. As ductility and toughness of the reactive composition increase, safe handling of the reactive composition may also increase, both during and after processing.

The reactive composition utilizing the polymer/plasticizer system may be processed in extruders, injection molders, and similar processing equipment. If the metal material has a melting point from approximately 46° C. to approximately 250° C. and the energetic material is a liquid at the processing temperature, the reactive composition may be produced by a melt-pour process in an existing melt-pour facility. Therefore, new equipment and facilities may not be necessary to produce the reactive composition. If the metal material has a melting point ranging from approximately 75° C. to approximately 105° C. and the energetic material is a liquid at the processing temperature, the reactive composition may be produced in existing melt-pour facilities used to produce conventional TNT-containing explosives. While it is desirable for the reactive composition to be produced by a melt-pour technique, it is contemplated that the reactive composition may be produced by other techniques, especially if the energetic material is a solid material.

By utilizing the metal material as the continuous phase, the reactive composition may have an increased detonation rate compared to the detonation rate of a conventional reactive composition. The reactive composition may also have a higher density than that of a conventional reactive composition. In addition, the reactive composition may be more insensitive to accidental discharge than conventional compositions, as measured by sensitivity tests known in the art. For instance, the reactive composition may be insensitive to friction, electrostatic, impact, and thermal incompatibility. The reactive composition may also have a high initiation threshold.

The reactive composition of the present invention may be used in ordnance, such as bullets, reactive bullets, grenades, warheads (including shape charges), mines, mortar shells, artillery shells, bombs, and demolition charges. For instance, the reactive composition may be used as a fill material in a reactive material bullet. The reactive composition may also be used as a shape charge liner, such as in a warhead. The reactive composition may also be used to provide enhanced blast, such as by adding the second metal material, such as $AlH_3$, to the reactive composition. The reactive composition may also be formulated for use as a propellant or a gas generant.

The following examples serve to explain embodiments of the present invention in more detail. These examples are not to be construed as being exhaustive or exclusive as to the scope of this invention.

EXAMPLES

Example 1

Preparation of Reactive Compositions Including INDALLOY® 174 and TNAZ

To form a reactive composition having 77.5% INDALLOY® 174 and 22.5% TNAZ (Formulation A), 775 grams of INDALLOY® 174 and 225 grams TNAZ were melted in separate, plastic, heat-resistant beakers and stirred with wood or TEFLON® rods. During melting of the TNAZ, care was taken to avoid a buildup of subliming reactive composition on the interior of the oven. The melted TNAZ was then poured into the INDALLOY® 174 and stirred thoroughly. The INDALLOY® 174/TNAZ mixture was heated at 100° C. for 5 minutes while stirring. The INDALLOY® 174/TNAZ mixture was removed from the oven and stirred until the viscosity had increased sufficiently to suspend the TNAZ. The INDALLOY® 174/TNAZ mixture was then cast into an item, such as a mold, that had been previously heated to 100° C. The item was overcast and pressed down on the top until set.

Reactive compositions having 63% INDALLOY® 174 and 37% TNAZ (Formulation B) and 50% INDALLOY® 174 and 50% TNAZ (Formulation C) were prepared as described above by varying the relative amounts of INDALLOY® 174 and TNAZ.

Example 2

Preparation of Reactive Compositions Including Wood's Metal and TNAZ

A reactive composition having 63% Wood's Metal and 37% TNAZ (Formulation E) was prepared as described in Example 1, except that Wood's Metal was used instead of the INDALLOY® 174.

Example 3

Preparation of Reactive Compositions Including INDALLOY® 174 and TNT

A reactive composition having 70% INDALLOY® 174 and 30% TNT (Formulation G) was prepared as described in Example 1, except that TNT was used instead of TNAZ.

Example 4

Preparation of Reactive Compositions Including INDALLOY® 174 and DNT

To form a reactive composition having 75% INDALLOY® 174 and 25% DNT (Formulation F), 750 grams of INDALLOY® 174 and 250 grams DNT were melted in separate, plastic, heat-resistant beakers and stirred with wood or TEFLON® rods. The melted DNT was then poured into the INDALLOY® 174 and stirred thoroughly. The INDALLOY® 174/DNT mixture was heated at 100° C. for 5 minutes while stirring. The INDALLOY® 174/DNT mixture was removed from the oven and stirred until the viscosity had increased sufficiently to suspend the DNT. The INDALLOY® 174/DNT mixture was then cast into an item that had been previously heated to 100° C. The item was overcast and pressed down on the top until set.

Example 5

Preparation of Reactive Compositions Including INDALLOY® 174 and AP

To form a reactive composition having 75% INDALLOY® 174 and 25% AP (Formulation J), 750 grams of INDALLOY® 174 and 250 grams AP were melted in a plastic, heat-resistant beaker while stirring with wood or TEFLON® rods. The AP was incorporated into the INDALLOY® 174 to produce a paste-like material. The INDALLOY® 174/AP paste was removed from the oven. The INDALLOY® 174/AP paste was added in increments to an item that had been previously heated to 100° C. and tamped gently between additions. The item was overcast and pressed down on the top until set.

Example 6

Preparation of Reactive Compositions Including INDALLOY® 174 and KN

Reactive compositions including 77.5% INDALLOY® 174 and 22.5% KN (Formulation K) and 75% INDALLOY®

174 and 25% KN (Formulation L) were prepared as described in Example 5, except that KN was used instead of AP.

Example 7

Preparation of Reactive Compositions Including INDALLOY® 174 and TATB

A reactive composition including 91% INDALLOY® 174 and 9% TATB (Formulation H) was prepared as described in Example 5, except that TATS was used instead of AP.

Example 8

Preparation of Reactive Compositions Including INDALLOY® 174 and HMX

A reactive composition including 63% INDALLOY® 174 and 37% HMX (Formulation I) was prepared as described in Example 5, except that HMX was used instead of AP.

Example 9

Preparation of Reactive Compositions Including INDALLOY® 174, TNAZ, and $AlH_3$

A reactive composition having 50.5% INDALLOY® 174, 29.5% TNAZ, and 20% $AlH_3$ (Formulation D) was prepared as described in Example 1, with the addition of $AlH_3$ to the INDALLOY® 174/TNAZ mixture.

Example 10

Preparation of Reactive Compositions Including Wood's Metal, TNAZ, and $AlH_3$

A reactive composition having 50.5% Wood's Metal, 29.5% TNAZ, and 20% $AlH_3$ (Formulation M) is prepared as described in Example 1, with the addition of $AlH_3$ to the Wood's Metal/TNAZ mixture.

Example 11

Calculated Detonation Performance of the Reactive Compositions

CHEETAH 3.0 thermochemical code, developed by L. E. Fried, W. M. Howard, and P. C. Souers, was used to calculate detonation performance parameters for the reactive compositions described in Examples 1-10. CHEETAH 3.0 models detonation performance parameters of ideal explosives and is available from Lawrence Livermore National Laboratory (Livermore, Calif.). The detonation performance parameters of the reactive compositions were compared to those of the conventional explosive compositions, such as isopropyl nitrate ("IPN")/Mg (Formulation N); IPN/RDX/A1, (Formulation O); DNANS/methylnitroaniline/RDX/AP/A1 (Formulation P); and RM4/nitromethane (Formulation Q).

TABLE 1

Calculated Detonation Performance Comparison at 99% Theoretical Maximum Density ("TMD")

| Formulation | Density 99% TMD (g/cc) | Detonation Pressure (kbar) | Detonation Velocity (km/s) | Detonation Temperature (K.) | Heat of Combustion (cal/g × $10^3$) | $H_2$ (mol/kg × $10^{-40}$) | Total Energy (kJ/cc) |
|---|---|---|---|---|---|---|---|
| A<br>77.5% INDALLOY ® 174<br>22.5% TNAZ | 4.63 | 307 | 3.55 | 3448 | 0.61 | | 6.34 |
| B<br>63% INDALLOY ® 174<br>37% TNAZ | 3.59 | 359 | 4.60 | 4087 | 0.89 | | 8.22 |
| C<br>50% INDALLOY ® 174<br>50% TNAZ | 2.99 | 381 | 5.54 | 4391 | 1.14 | | 9.29 |
| D<br>50.5% INDALLOY ® 174<br>29.5% TNAZ<br>20% $AlH_3$ | 2.79 | 198 | 5.11 | 5039 | 2.60 | | 16.09 |
| E<br>63% Wood's Metal<br>37% TNAZ | 3.67 | 364 | 4.82 | 4111 | 0.92 | | 8.33 |
| F<br>75% INDALLOY ® 174<br>25% DNT | 3.92 | 99.8 | 3.31 | 2202 | 0[c] | | 0[c] |
| G<br>70% INDALLOY ® 174<br>30% TNT | 3.76 | 241 | 3.93 | 3229 | 1.16 | | 5.51 |
| H<br>91% INDALLOY ® 174<br>9% TATB | —[a] | —[a] | —[a] | —[a] | —[a] | | —[a] |
| I<br>63% INDALLOY ® 174<br>37% HMX | 3.69 | 375 | 4.62 | 3580 | 0.89 | | 7.93 |
| J<br>75% INDALLOY ® 174<br>25% AP | 4.59 | 329 | 3.60 | 2536 | 0.22 | | 4.07 |
| K<br>77.5% INDALLOY ® 174<br>22.5% KN | 5.00[b,c] | 30.4 | 2.33 | 541 | 0[c] | | 0[c] |
| L<br>75% INDALLOY ® 174<br>25% KN | 4.80 | 22.7 | 2.22 | 376 | 0[c] | | 0[c] |

TABLE 1-continued

Calculated Detonation Performance Comparison at 99% Theoretical Maximum Density ("TMD")

| Formulation | Density 99% TMD (g/cc) | Detonation Pressure (kbar) | Detonation Velocity (km/s) | Detonation Temperature (K.) | Heat of Combustion (cal/g × $10^3$) | $H_2$ (mol/kg × $10^{-40}$) | Total Energy (kJ/cc) |
|---|---|---|---|---|---|---|---|
| M<br>50.5% Wood's Metal<br>29.5% TNAZ<br>20% $AlH_3$ | 2.86 | 190 | 5.14 | 4898 | 2.71 | 0.3 | 16.46 |
| N<br>IPN<br>Mg | 1.24 | 72 | 4.78 | 4905 | 5.27 | 0.4 | 11.84 |
| O<br>IPN<br>Al<br>RDX | 1.53 | 192 | 7.05 | 4928 | 3.70 | 0.4 | 10.69 |
| P<br>DNANS<br>MNA<br>RDX<br>AP<br>Al | 1.84 | 232 | 7.48 | 5043 | 3.58 | 0.2 | 12.90 |
| Q<br>50% RM4<br>50% Nitromethane | 1.59 | 187 | 5.73 | 4847 | 3.03 | 0.2 | 9.15 |

[a]CHEETAH does not calculate densities above 5 g/cc.
[b]Data was generated at a density of 98.8% TMD.
[c]CHEETAH did not calculate these parameters.

The CHEETAH program was unable to adequately calculate the heat of combustion and total energy for Formulation F, which may have been a result of the low detonation temperature. However, the CHEETAH program was able to calculate these parameters for Formulation G, which had a significantly greater detonation temperature. Formulation H had too great a density to be calculated. Formulations K and L, which included the inorganic oxidizer KN, had a relatively large negative heat of formation that caused it to be nearly inert and difficult to obtain useful detonation parameters when combined with the fusible metal alloy.

As shown in Table 1, many of the reactive compositions (Formulations A, B, F, G, I, and J) had higher calculated detonation pressures and lower calculated detonation velocities than those of Formulation N, indicating that these reactive compositions had improved, calculated, performance properties. Reactive compositions A-M also had significantly higher densities than that of Formulation N.

The reactive compositions that included $AlH_3$ as the second metal material also had increased, calculated, detonation parameters. For instance, the addition of $AlH_3$, as in Formulations D and M, drastically boosted the detonation temperature, heat of combustion, and total energy of the reactive compositions. A comparison of the reactive compositions having INDALLOY® 174 or Wood's Metal as the metal material and TNAZ or HMX as the energetic material showed that as the relative amount of energetic material increased, the density of the explosive composition decreased and each of the other parameters increased.

Example 12

Compatibility of the Reactive Compositions

Compatibility of the metal material, the energetic material, and the second metal material was also determined. Differential Scanning Calorimetry ("DSC") compatibility data for INDALLOY® 174 with various energetic materials and $AlH_3$ is shown in Table 2.

TABLE 2

DSC Comparison of INDALLOY ® 174 and Energetic Materials

| Components | Alloy:Additive | DSC (exotherm onset, ° C.) |
|---|---|---|
| INDALLOY ® 174 | 1:0 | — |
| Alane ($AlH_3$) | 0:1 | 188 |
| Alane ($AlH_3$) | 2:1 | 192 |
| Alane ($AlH_3$) | 3:1 | 188 |
| Alane ($AlH_3$) | 4:1 | 191 |
| CL-20 | 1:1 | 242 |
| CL-20 | 3:1 | 243 |
| TEX | 2:1 | 301 |
| TEX | 3:1 | 296 |
| TNAZ | 3:1 | 257 |
| TNAZ | 4:1 | 256 |

Example 13

Sensitivity of the Reactive Compositions

Hazard properties were also determined for the reactive compositions that contained INDALLOY® 174. Laboratory scale hazard properties (impact, friction, ESD, and thermal incompatibility) were measured for the compositions that contained INDALLOY® 174, as shown in Table 3. These properties were measured by conventional techniques known in the art.

The detonation performance of these reactive compositions was measured by a Dent and Rate test. A test sample of each of the reactive compositions was held in a steel pipe (3.7 cm diameter×14 cm length) that had five holes drilled in the side for velocity switches from which the detonation velocity was calculated by regression analysis. The test sample was detonated using a booster that was 160 grams pentolite (50 pentaerythritol tetranitrate ("PETN"):50 TNT) and the depth of the dent made in a witness plate was measured. The dent depth was correlated to the detonation pressure, with a deeper dent corresponding to a higher pressure.

TABLE 3

Laboratory Scale Hazards Property and Dent and Rate Comparison

| Formulation | INDALLOY ® 174 | A | B | C | D | E | F | G | H | I | J | K | L |
|---|---|---|---|---|---|---|---|---|---|---|---|---|---|
| Oxidizer Particle Size | | | | | | | | | Fine | 5-100 | 200 | 20 | 400 |
| Density (g/cc, measured) | 8.54 | | 3.42 | 2.88 | | | 3.81 | 3.78 | | | 4.66 | | 5.68 |
| ABL Impact (cm)[a] | 80 | 1.8 | | | 1.1 | 800 | 80 | | 13 | 1.8 | 1.8 | 21 | 80 |
| BOE Impact (4")[b] | Pass | Fail | | | | >8 | Pass | | Pass | | Pass | Pass | Pass |
| ABL Friction (psi @ 8 ft/sec)[c] | 800 | 800 | | | <25@2 | 163 | 800 | 800 | 800 | 25@3 | 25 | 800 | 800 |
| TC ESD (J)[d] | >8 | >8 | | | 0.92 | | 5.23 | 1.23 | 7.3 | 1.5 | >8 | >8 | >8 |
| SBAT (exotherm onset, ° C.)[e] | None | 163 | | | 117 | | 219 | 197 | 167 | 206 | 182 | 174 | 171 |
| DSC (exotherm onset, ° C.) | — | 259 | | | | | 334 | | | | 440 | | |
| VTS (ml/g)[f] | 0.19 | 0.23 | | | | | 0.25 | | | | 0.19 | 0.20 | 0.22 |
| TGA under $N_2$ (% weight loss@x° C. | 1.8@188 | 25.9@212 | | | | | 35.4@248 | | | | 36.6@400 | 11.5@754 | 10.7@649 |
| Dent depth (mm) | 0.0 | 1.4 | | | | 9.9 | 0.0 | | | | 0.0 | | 0.0 |
| Detonation Velocity (km/s) | 2.3 | 6.9 | | | | 8.4 | 2.0 | | | | 2.2 | | 0.8 |

[a]Threshold Initiation Level (TIL) for 20 no-fire drops per drop height
[b]Pass is six of ten no-fire impacts
[c]TIL for 20 no-fires
[d]50% ignition point
[e]Simulated Bulk Autoignition Temperature measures the ability of a sample to absorb heat where an exotherm <107° C. indicates a sensitive material
[f]Vacuum Thermal Stability at 75° C. for 48 hours As shown in Table 3, neat INDALLOY® 174 was inert and gave hazard results at the least sensitive limit of each test. The TNAZ and AP reactive compositions (Formulations A-E, and M) were sensitive to impact but were otherwise insensitive. Formulation E was resistant to application of a hot wire but burned with a continuous hot flame once ignited. The resulting reactive composition was resistant to application of a hot wire but burned with a continuous hot flame when ignited. The DNT and KN reactive compositions (Formulations F, K, and L) were nearly as insensitive as the neat INDALLOY® 174. The Vacuum Thermal Stability ("VTS") showed no volatile loss from any reactive composition. The thermogravimetric Analysis ("TGA") of neat INDALLOY® 174 indicated some weight loss at 188° C., which was well above the normal processing temperatures of 100-110° C. The TGA of Formulation A showed significant weight loss at 212° C. that represented all of the TNAZ in the explosive composition. However, at 100° C., the TNAZ loss was only approximately 1%, which was acceptable for short processing times. In each of the other cases, TGA weight loss occurred at a temperature that was well above the processing temperature. In addition to the Formulations shown in Table 3, an insensitive reactive composition having Wood's Metal and TEX was also produced. A formulation having 63% Wood's Metal and 37% TNAZ had a TC impact of 26.1 in, an ABL friction of 800 psi @ 8 ft/s, a TC ESD of >8 J, and an SBAT (onset) at 163° C.

As indicated in Table 3, the measured dent depth of 9.9 mm for Formulation E was significantly less than the dent depth anticipated from the calculated detonation pressure of 364 kbar, which is similar to the dent depth observed with Composition B or Composition C. However, the observed detonation velocity of 8.4 km/s was 85% greater than calculated and was similar to the detonation velocity observed for very high-energy pressed explosives, such as LX-14, which has 95.5% HMX. Similar results were observed for Formulation A. The reactive compositions that contained DNT, AP, and KN (Formulations F and J-L) gave similar results to the neat INDALLOY® 174.

Example 14

Safety Results for Reactive Compositions including the Polymer/Plasticizer System Formulations having the components listed in Table 4 were produced and safety testing was performed on these formulations. Impact properties of the formulations were measured using an impact test developed by Thiokol Corporation ("TC"). Friction properties of the formulations were measured using a friction test developed by Allegheny Ballistics Laboratory ("ABL"). Electrostatic discharge ("ESD") of the formulations was measured using an ESD test developed by TC. Onset of ignition exotherms and sensitivity to elevated temperatures of the formulations were measured using a Simulated Bulk Autoignition Test ("SBAT"). These tests are known in the art and, therefore, details of these tests are not included herein.

TABLE 4

Safety Properties of Reactive Compositions that Include the Polymer/Plasticizer System.

| Formulation | TC Impact (in.) | ABL Friction (lbs) | TC ESD (J) | SBAT Onset (° F.) |
|---|---|---|---|---|
| 90% INDALLOY ® 174<br>10% KP | >46 | 800 @ 8 fps | >8 | 340 |

TABLE 4-continued

Safety Properties of Reactive Compositions that Include the Polymer/Plasticizer System.

| Formulation | TC Impact (in.) | ABL Friction (lbs) | TC ESD (J) | SBAT Onset (° F.) |
|---|---|---|---|---|
| 80% INDALLOY ® 174<br>20% KP | 33.55 | 660 @ 8 fps | >8 | 349 |
| 60% INDALLOY ® 174<br>40% KP | 41.2 | 100 @ 6 fps | | |
| 85.5% INDALLOY ® 174<br>9.5% KP<br>1% CAB<br>4% BDNPA/F | 43.86 | 50 @ 4 fps | >8 | 309 |
| 76% INDALLOY ® 174<br>19% KP<br>1% CAB<br>4% BDNPA/F | 14.33 | 50 @ 3 fps | >8 | 317 |
| 68% INDALLOY ® 174<br>14.5% KP<br>14.5% RDX<br>0.4% CAB<br>2.6% BDNPA/F | 13.91 | <25 @ 2 fps | 7.5 | 308 |
| 57% INDALLOY ® 174<br>38% KP<br>1% CAB<br>4% BDNPA/F | 18.64 | 25 @ 4 fps | >8 | 376 |
| 25% INDALLOY ® 174<br>28% KP<br>28% RDX<br>10% Mg<br>1.5% CAB<br>8% BDNPA/F | 18.64 | 25 @ 4 fps | >8 | 336 |
| 20% INDALLOY ® 174<br>70% CL-20<br>1% CAB<br>9% BDNPA/F | 19.90 | 25 @ 6 fps | >8 | 310 |
| 20% INDALLOY ® 174<br>55% CL-20<br>15% Mg<br>1% CAB<br>9% BDNPA/F | 16.82 | 25 @ 2 fps | 7.25 | 345 |
| 18% INDALLOY ® 174<br>76% RDX<br>6% CBN and BDNPA/F | 21.55 | 800 @ 8 fps | >8 | 287 |
| 17% INDALLOY ® 174<br>78% KP<br>5% CBN and BDNPA/F | 18.80 | 800 @ 8 fps | >8 | 287 |
| 14% INDALLOY ® 174<br>81% KP<br>5% CBN and BDNPA/F | 18.67 | 800 @ 8 fps | >8 | 371 |
| 13.5% INDALLOY ® 174<br>82% RDX<br>4.5% CBN and BDNPA/F | 18.45 | 800 @ 8 fps | 7.5 | 350 |

The results depicted in Table 4 show that the reactive compositions including the polymer/plasticizer system have good safety properties.

Example 15

Reactive Compositions Including the Polymer/Plasticizer System

A quantitative analysis of the effect of the polymer/plasticizer system was deter mined by testing two similar formulations of the reactive composition for compressive strength in a'/2-inch diameter cylindrical pellet configuration. The first formulation included 60% INDALLOY® 174 and 40% KP and is referred to herein as the reactive material enhanced bullet-1 ("RMEB-1") formulation. The second formulation included 56.85% INDALLOY® 174, 37.9% KP, and 5.25% of the polymer/plasticizer system and is referred to as the "RMEB-1 w/binder" formulation. The polymer/plasticizer system included 1.0 wt % CAB and 4.25 wt % BDNPA/F. Both of the tested formulations had the same ratio of the INDALLOY® 174 to the oxidizer.

Figure 2:
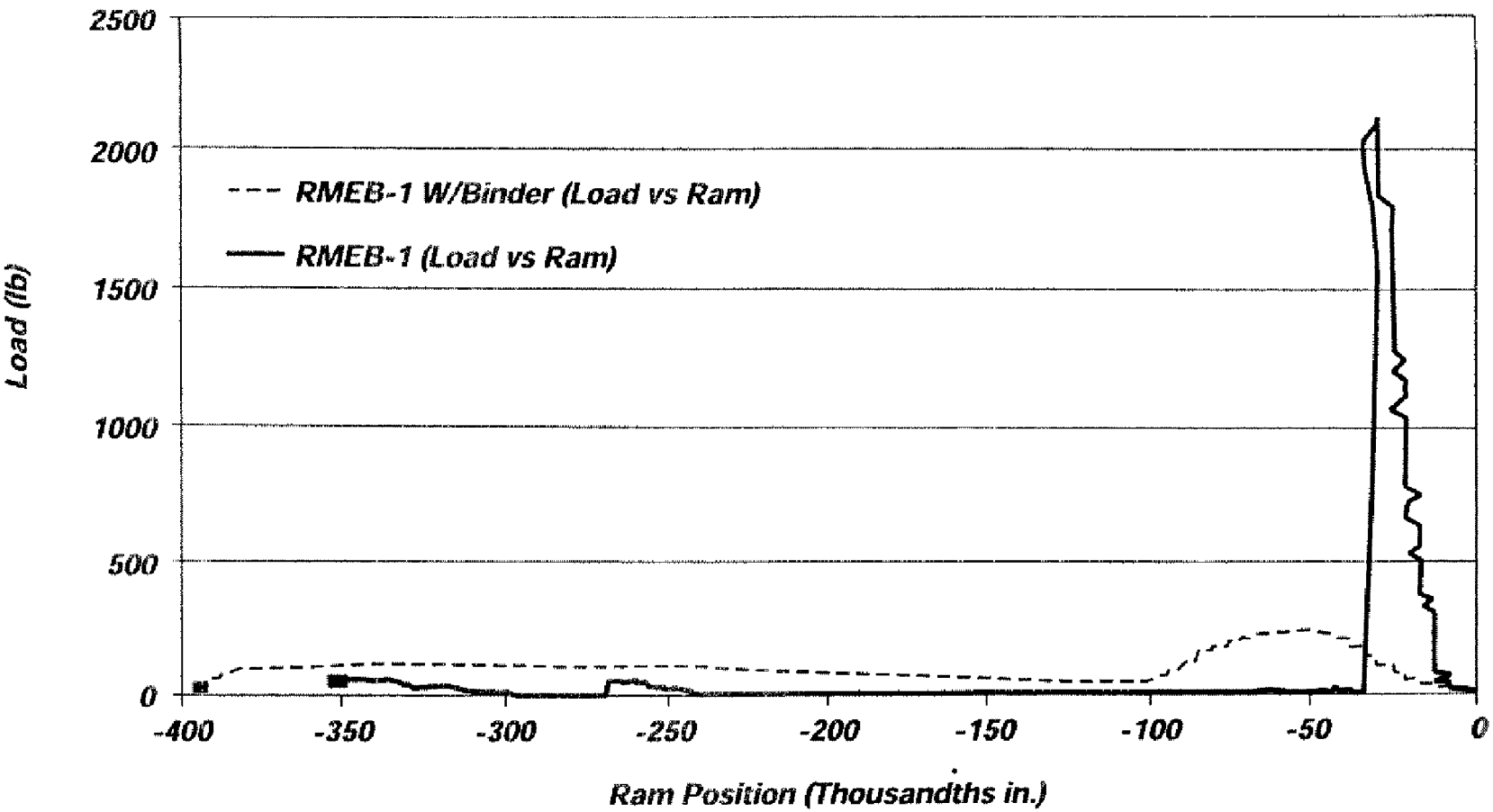

Each of the formulations was formed into a ½-inch diameter cylindrical pellet and compressive strength tests were performed on each of the pellets as known in the art. As shown in FIGS. 1 and 2, the RMEB-1 formulation was able to withstand a higher load. However, the RMEB-1 w/binder formulation exhibited more elastic deformation even though only a small amount of the polymer/plasticizer system was used. The RMEB-1 w/binder formulation also exhibited the ability to flow under a load and to resist deformation.

Figure 3:
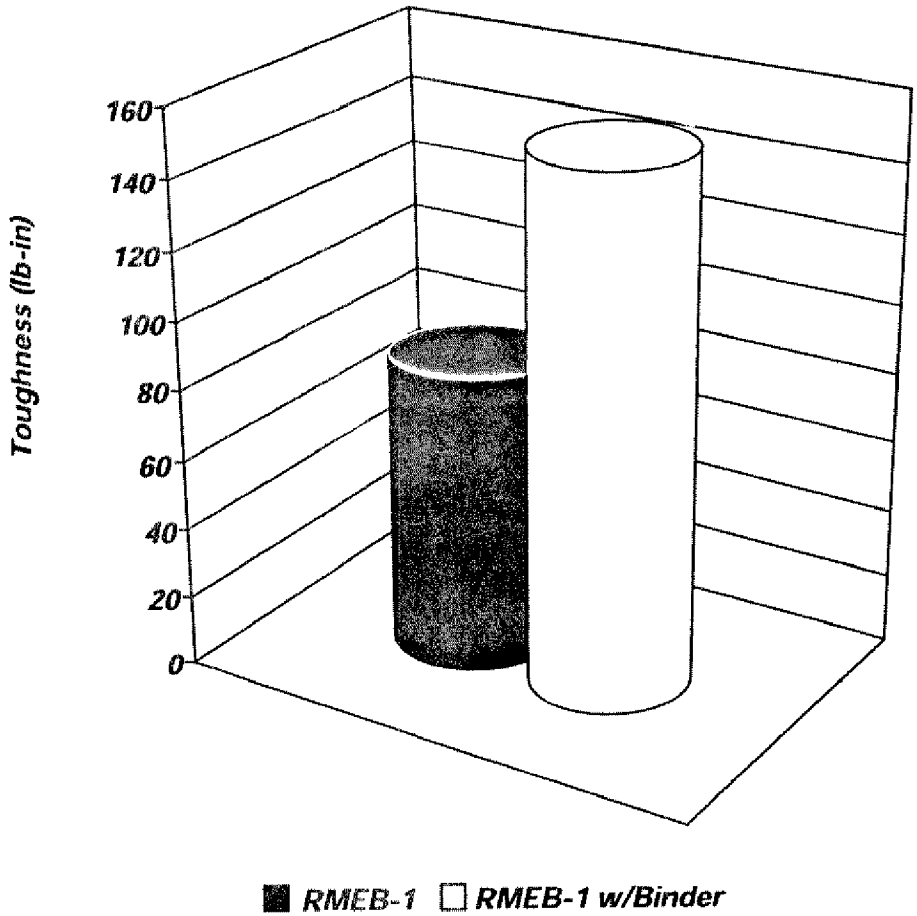
Figure 4:
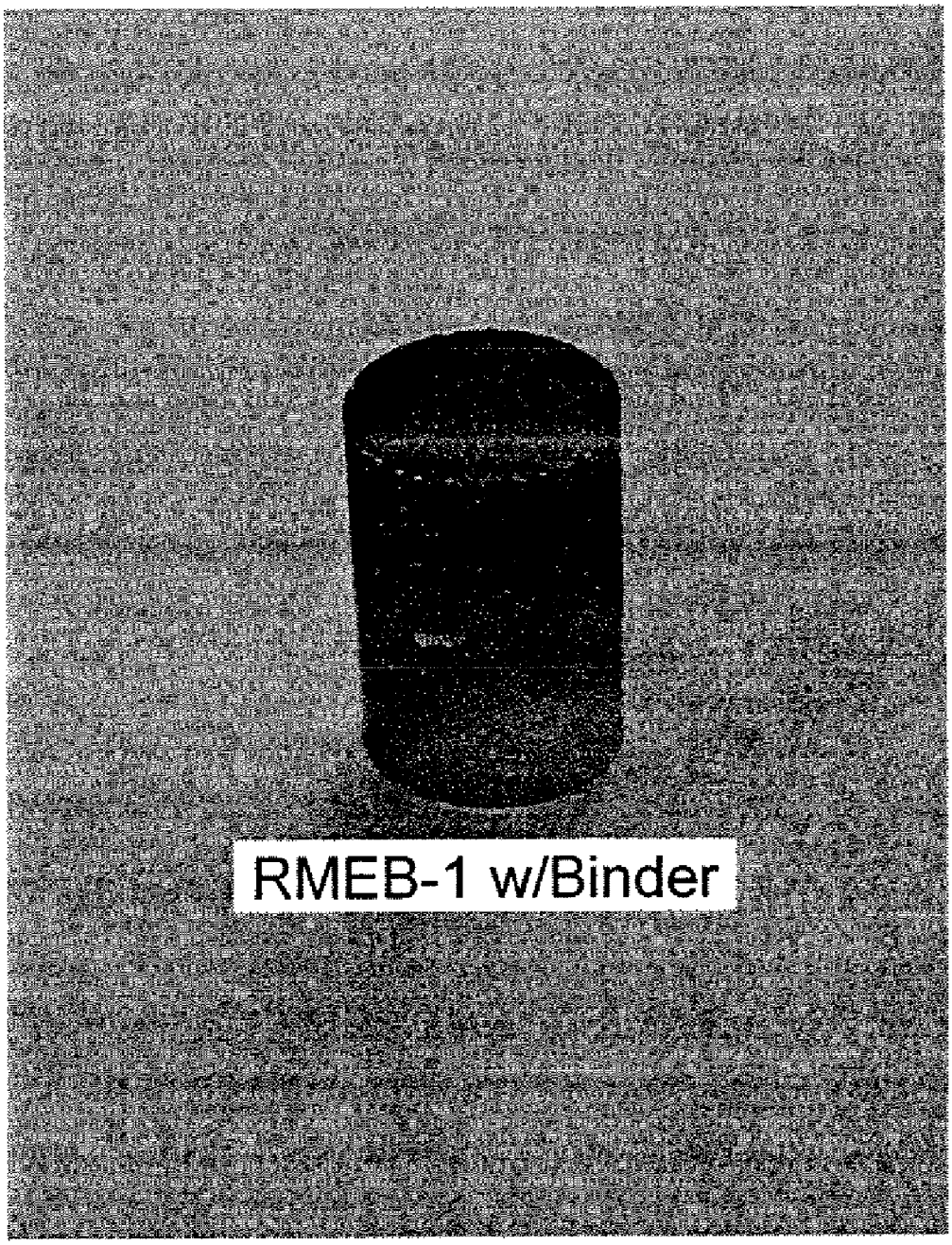
FIGS. 4-7 show photographs of pellets of the reactive compositions before and after the compressive strength tests.
Figure 5:
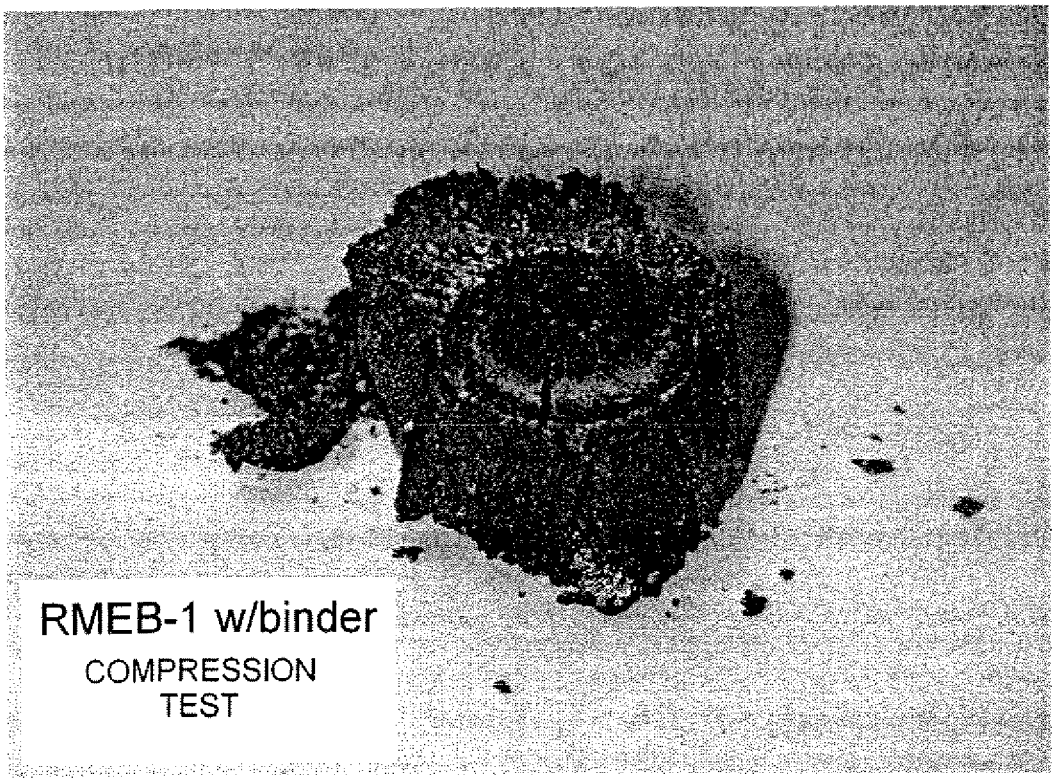
Figure 6:
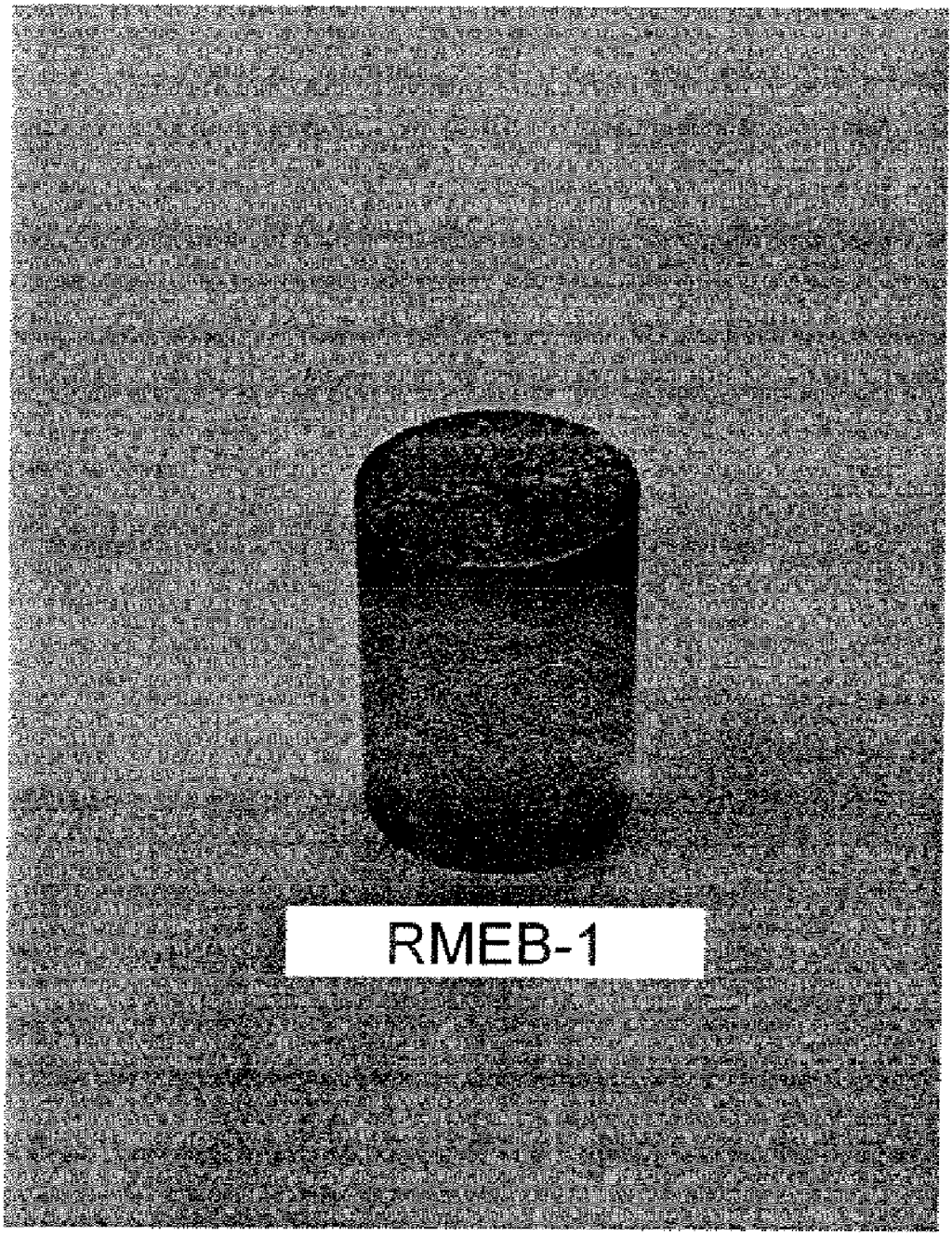
Figure 7:
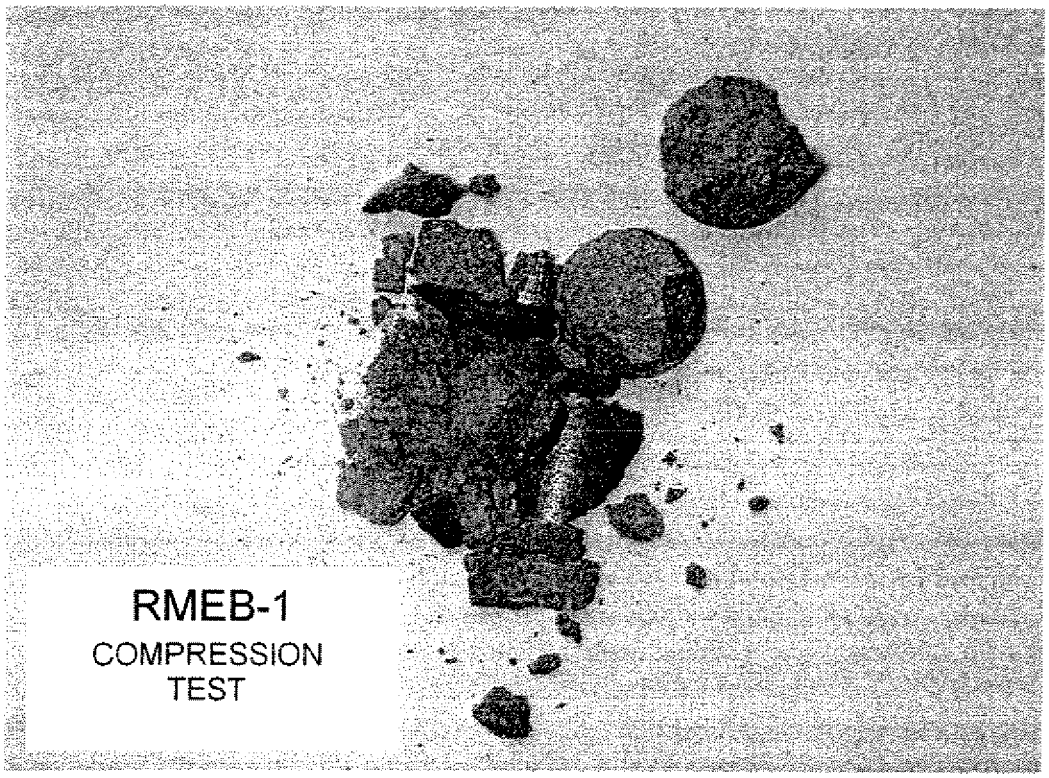

In order to determine the effect of the polymer/plasticizer system, the toughness of each form was calculated by integrating each curve. As shown in FIG. 3, the RMEB-1 w/binder formulation was almost twice as tough as the RMEB-1 formulation. As such, the RMEB-1 w/binder formulation is less likely to fracture. Fractured materials are less stable and more prone to premature initiation from external stimuli than nonfractured materials. In contrast, the RMEB-1 formulation was less tough, more brittle and more prone to fracture. Photographs of the pellets before and after the compressive strength tests are shown in FIGS. 4-7.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A precursor composition of a reactive material, comprising:

a metal material comprising at least one oxidizer dispersed therein, the metal material defining a continuous phase at a processing temperature of a precursor composition of a reactive material and comprising bismuth, indium, and tin, and the at least one oxidizer selected from the group consisting of ammonium perchlorate, potassium perchlorate, sodium nitrate, potassium nitrate, ammonium nitrate, lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, copper oxide, sulfur, and mixtures thereof.

2. The precursor composition of claim 1, wherein the metal material comprises 57% bismuth, 26% indium, and 17% tin.

3. The precursor composition of claim 1, further comprising a polymer/plasticizer system.

4. The precursor composition of claim 3, wherein the precursor composition comprises a substantially homogenous mixture of the metal material and the at least one oxidizer.

5. The precursor composition of claim 3, wherein the polymer/plasticizer system comprises at least one polymer selected from the group consisting of polyglycidyl nitrate, nitratomethylmethyloxetane, polyglycidyl azide, diethyleneglycol triethyleneglycol nitraminodiacetic acid terpolymer, poly(bis(azidomethyl)oxetane), poly(azidomethylmethyl-oxetane), poly(nitraminomethyl methyloxetane), poly (bis(difluoroaminomethyl)oxetane), poly (difluoroaminomethylmethyloxetane), copolymers thereof, cellulose acetate butyrate, nitrocellulose, nylon, polyester, fluoropolymers, energetic oxetanes, waxes, and mixtures thereof.

6. The precursor composition of claim 3, wherein the polymer/plasticizer system comprises at least one plasticizer selected from the group consisting of bis(2,2-dinitropropyl) acetal/bis(2,2-dinitropropyl)formal, dioctyl sebacate, dimethylphthalate, dioctyladipate, glycidyl azide polymer, diethyleneglycol dinitrate, butanetrioltrinitrate, butyl-2-nitratoethyl-nitramine, trimethylolethanetrinitrate, triethylene glycoldinitrate, nitroglycerine, isodecylperlargonate, dioctylphthalate, dioctylmaleate, dibutylphthalate, di-n-propyl adipate, diethylphthalate, dipropylphthalate, citroflex, diethyl suberate, diethyl sebacate, diethyl pimelate, and mixtures thereof.

7. The precursor composition of claim 1, further comprising a second metal material selected from the group consisting of aluminum, nickel, magnesium, silicon, boron, beryllium, zirconium, hafnium, zinc, tungsten, molybdenum, copper, titanium, sulfur, aluminum hydride, magnesium hydride, a borane compound, and mixtures thereof.

8. The precursor composition of claim 1, wherein the precursor composition comprises a heterogeneous, granulated mixture of the metal material and the energetic material.

9. The precursor composition of claim 1, further comprising at least one class 1.1 explosive selected from the group consisting of trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.0$^{5,9}$.0$^{3,11}$]-dodecane, 1,3,3-trinitroazetidine, ammonium dinitramide, 2,4,6-trinitro-1,3,5-benzenetriamine, dinitrotoluene, and mixtures thereof.

10. A precursor composition of a reactive material, comprising:

a metallic melt phase comprising at least one oxidizer dispersed therein, the metallic melt phase comprising bismuth, indium, and tin.

11. The precursor composition of claim 10, wherein the at least one oxidizer comprises an oxidizer selected from the group consisting of ammonium perchlorate, potassium perchlorate, sodium nitrate, potassium nitrate, ammonium nitrate, lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, copper oxide, sulfur, and mixtures thereof.

12. The precursor composition of claim 10, wherein the metallic melt phase comprises 60% of the precursor composition and the at least one oxidizer comprises 40% of the precursor composition.

13. The precursor composition of claim 10, wherein the metallic melt phase comprises 90% of the precursor composition and the at least one oxidizer comprises 10% of the precursor composition.

14. A precursor composition of a reactive material, comprising:

at least one oxidizer dispersed in a molten metal, the at least one oxidizer selected from the group consisting of ammonium perchlorate, potassium perchlorate, sodium nitrate, potassium nitrate, ammonium nitrate, lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, copper oxide, sulfur, and mixtures thereof and the molten metal comprising bismuth, indium, and tin.

15. The precursor composition of claim 10, wherein the metallic melt phase comprises 80% of the precursor composition and the at least one oxidizer comprises 20% of the precursor composition.

16. A precursor composition of a reactive material, comprising:

a metal material comprising at least one oxidizer dispersed therein, the metal material consisting of bismuth, indium, and tin and the at least one oxidizer comprising potassium perchlorate.

* * * * *